US009322179B2

(12) United States Patent
Oberg

(10) Patent No.: US 9,322,179 B2
(45) Date of Patent: Apr. 26, 2016

(54) ROOFING SUSPENSION SUPPORT

(76) Inventor: Craig Oberg, Ephraim, UT (US)

( * ) Notice: Subject to any disclaimer, the term of this patent is extended or adjusted under 35 U.S.C. 154(b) by 0 days.

(21) Appl. No.: 13/332,176

(22) Filed: Dec. 20, 2011

(65) Prior Publication Data

US 2012/0174502 A1 Jul. 12, 2012

Related U.S. Application Data

(60) Provisional application No. 61/424,979, filed on Dec. 20, 2010.

(51) Int. Cl.
*E04D 13/16* (2006.01)

(52) U.S. Cl.
CPC ..... *E04D 13/1637* (2013.01); *E04D 13/1618* (2013.01); *E04D 13/1625* (2013.01)

(58) Field of Classification Search
CPC ..... E04D 13/1618; E04D 13/1625; E04D 13/1637
USPC ..... 52/404.1, 404.3, 404.5, 506.3, 506.6, 52/543, 700, 712, 741.4, 39, 714; 248/237
See application file for complete search history.

(56) References Cited

U.S. PATENT DOCUMENTS 1,786,751 A * 12/1930 Heeren ..... 52/335
2,236,082 A * 3/1941 Wright ..... 52/700
2,300,113 A * 10/1942 Faber ..... 52/92.1
2,467,115 A * 4/1949 Duggan ..... 52/699
2,579,052 A * 12/1951 Schofield ..... 108/157.13
2,841,255 A * 7/1958 Kemp ..... 52/395
2,995,872 A * 8/1961 Barker ..... 52/714
3,085,666 A * 4/1963 Lydard ..... 52/506.06
3,334,465 A * 8/1967 Hoffmann, Jr. ..... 52/718.05
3,389,524 A * 6/1968 Weber ..... 52/713
3,389,525 A * 6/1968 Moody ..... 52/714
3,417,535 A * 12/1968 Zuckerman ..... 52/650.3
3,612,461 A * 10/1971 Brown ..... 248/317
3,648,421 A * 3/1972 Bjork ..... 52/99
3,708,941 A * 1/1973 Cuckson ..... 52/506.08
3,998,020 A * 12/1976 Kuhr et al. ..... 52/506.07
3,998,026 A * 12/1976 Allen ..... 52/714
4,040,758 A * 8/1977 Sauer ..... 403/397
4,044,521 A 8/1977 Fischer et al.
4,115,484 A * 9/1978 Saxton ..... 261/111
4,117,641 A 10/1978 Wells
4,133,161 A 1/1979 Lester
4,181,692 A * 1/1980 Stone ..... 261/111
4,263,763 A 4/1981 Bouwens
4,266,384 A * 5/1981 Orals et al. ..... 52/410
4,275,541 A * 6/1981 Orals et al. ..... 52/481.1
4,333,291 A * 6/1982 Musgrave et al. ..... 52/404.2
4,333,292 A * 6/1982 Musgrave ..... 52/404.2
4,375,741 A 3/1983 Paliwoda
4,375,742 A 3/1983 Paliwoda (Continued)

*Primary Examiner* — Michael Safavi
(74) *Attorney, Agent, or Firm* — Thorpe North & Western, LLP

(57) ABSTRACT

A roofing suspension support and related system and methods are disclosed. The roofing suspension support can comprise a support member, a purlin web coupling portion, and a fixture coupling feature. The purlin web coupling portion can be located at a top end of the support member. The web coupling portion can be configured to couple the support member to a web of a roofing purlin. The fixture coupling feature can be located at a bottom end of the support member. The fixture coupling feature can be configured to couple a fixture to the support member and to position the fixture below a lower flange of the purlin.

17 Claims, 4 Drawing Sheets

(56) References Cited

U.S. PATENT DOCUMENTS

| | | | | | |
|---|---|---|---|---|---|
| 4,384,437 | A | * | 5/1983 | Coles | 52/404.3 |
| 4,391,075 | A | | 7/1983 | Musgrave | |
| 4,434,601 | A | | 3/1984 | Zellmer | |
| 4,440,371 | A | * | 4/1984 | Wijsman | 248/318 |
| 4,525,972 | A | * | 7/1985 | Palacio et al. | 52/643 |
| 4,544,119 | A | * | 10/1985 | Kellett et al. | 248/58 |
| 4,635,423 | A | | 1/1987 | Ward | |
| 4,715,156 | A | * | 12/1987 | Dozzo | 52/404.3 |
| 4,723,749 | A | * | 2/1988 | Carraro et al. | 248/317 |
| 4,724,651 | A | | 2/1988 | Fligg | |
| 4,726,165 | A | * | 2/1988 | Brinsa | 52/665 |
| 4,838,507 | A | * | 6/1989 | Fricker | 248/230.1 |
| 4,875,320 | A | | 10/1989 | Sparkes | |
| 4,905,952 | A | * | 3/1990 | Pinquist | 248/317 |
| 4,930,285 | A | | 6/1990 | Ward | |
| 5,085,023 | A | | 2/1992 | Duffy | |
| 5,095,673 | A | | 3/1992 | Ward | |
| 5,119,612 | A | * | 6/1992 | Taylor et al. | 52/410 |
| 5,177,929 | A | * | 1/1993 | Reynolds | 52/745.05 |
| 5,357,722 | A | | 10/1994 | Kessler | |
| 5,425,209 | A | * | 6/1995 | Funaki | 52/359 |
| 5,442,890 | A | * | 8/1995 | Fligg | 52/742.12 |
| 5,535,560 | A | | 7/1996 | Fligg | |
| 5,564,250 | A | | 10/1996 | Kessler | |
| 5,581,966 | A | | 12/1996 | Fligg | |
| 5,636,487 | A | | 6/1997 | Fligg | |
| 5,893,250 | A | * | 4/1999 | Benvenuto et al. | 52/506.08 |
| 6,209,280 | B1 | * | 4/2001 | Bruce et al. | 52/702 |
| 6,324,808 | B1 | | 12/2001 | Lippy et al. | |
| 6,385,935 | B2 | | 5/2002 | Lippy | |
| 6,832,460 | B2 | | 12/2004 | Fligg | |
| 6,892,500 | B2 | * | 5/2005 | Zaborowski | 52/506.06 |
| 7,107,732 | B2 | | 9/2006 | Kinzler | |
| 7,254,928 | B2 | | 8/2007 | Fligg | |
| 7,735,285 | B2 | * | 6/2010 | Payne, Jr. | 52/506.07 |
| 7,743,572 | B2 | * | 6/2010 | Ducharme | 52/506.06 |
| 7,752,823 | B2 | * | 7/2010 | Robinson et al. | 52/664 |
| 8,096,089 | B2 | * | 1/2012 | Platt | 52/316 |
| 8,336,843 | B2 | * | 12/2012 | Gulbrandsen et al. | 248/317 |
| 2002/0011042 | A1 | | 1/2002 | Lippy et al. | |
| 2008/0104905 | A1 | | 5/2008 | Kinzler | |
| 2008/0250742 | A1 | | 10/2008 | Somola et al. | |
| 2011/0078973 | A1 | | 4/2011 | Oberg | |

* cited by examiner

ROOFING SUSPENSION SUPPORT

RELATED APPLICATION

This application claims the benefit of U.S. Provisional Patent Application No. 61/424,979, filed Dec. 20, 2010 and entitled "Roofing Suspension Support," which is incorporated herein by reference.

BACKGROUND

Metal roofs are well known and have been used for many years in commercial and industrial-type buildings. Typically, such roofs are constructed of parallel spaced joists or purlins over which are placed the various other components of the roof, including the roof deck. As energy efficiency standards have increased, new government requirements have forced metal roof manufacturers and installers to increase the amounts, types, and location of insulation used in the roofs.

SUMMARY

Thus, there is a need for a roofing suspension support that can suspend insulation below the roofing purlins. Accordingly, a roofing suspension support, system, and associated methods are provided. Such a roofing suspension support can comprise a support member, a purlin web coupling portion, and a fixture coupling feature. The purlin web coupling portion can be located at a top end of the support member. The web coupling portion can be configured to couple the support member to a web of a roofing purlin. The fixture coupling feature can be located at a bottom end of the support member. The fixture coupling feature can be configured to couple a fixture to the support member and to position the fixture below a lower flange of the purlin.

Additionally, a roofing suspension system in accordance with the principles herein can comprise a roofing purlin and a roofing suspension support. The roofing suspension support can have a support member, a purlin web coupling, and a fixture coupling portion. The coupling portion can be located at a top end of the support member and coupled to a web of the purlin. The fixture coupling feature can be located at a bottom end of the support member to couple a fixture to the support member and to position the fixture below a lower flange of the purlin.

Furthermore, a method of suspending a fixture from a roof in accordance with the principles herein can comprise coupling a top end of a support member to a web of a roofing purlin, wherein a bottom end of the support member extends below a lower flange of the purlin. The method can also comprise coupling a fixture to the bottom end of the support member.

Figure 1:
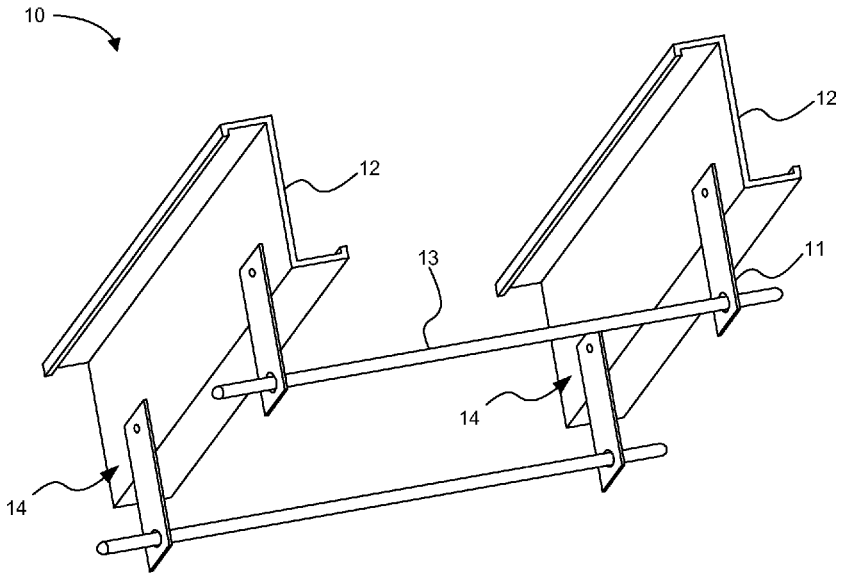
FIG. 1 is a lower perspective view of a roofing suspension system in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth a roofing suspension support and associated systems and methods that can support a fixture from a roofing purlin.

With the general embodiments set forth above, it is noted that when describing the roofing suspension support, or the related system or method, each of these descriptions are considered applicable to the other, whether or not they are explicitly discussed in the context of that embodiment. For example, in discussing the manufactured home transportation device per se, the system and/or method embodiments are also included in such discussions, and vice versa.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a fixture" includes one or more of such fixtures.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

As used herein, the term "threaded fastener" refers to any fastening device or combination of devices, which incorporates an at least partially threaded cylinder as a component of the device. Non-limiting examples of such devices include screws, bolts, and the like. In a particular aspect, self-tapping metal screws can be used.

A roof suspension support and related system and method are provided. FIG. 1 illustrates an example of a roofing suspension system 10, which incorporates a roof suspension support 11. The system 10 includes purlins 12, a roof suspension support 11, and a fixture 13. The purlins are typically configured to be arranged in a parallel or substantially parallel array such as shown in the figure. When the purlins are disposed in the parallel array, voids or spaces exist between the purlins. The purlins can be made of any metal or metal alloy having sufficient mechanical strength including but not limited to steel, alloys of steel, aluminum, and others. The purlins can take any suitable form which provides sufficient structural support for the roof including, but not limited, to I-beams, Z-shaped (shown in FIG. 1), C-shaped, tubular, or boxed purlins. The purlins frequently form a primary structural support for roof structures. As such, the purlins are typically attached to a vertical support, e.g. side walls and/or center supports. These purlins can generally be formed of a heavy gauge, although this can be varied depending on the installation requirements. As a general rule, the purlins are from about 16 gauge to about 12 gauge, and typically 14 gauge purlin. Other gauge material may be suitable for some designs. Another example of a roofing system that includes purlins can be seen in U.S. patent application Ser. No. 12/899,399, filed Oct. 6, 2010 and entitled Insulated Metal Roofing and Wall Systems and Related Methods, which is incorporated herein by reference.

Often, it is desirable to attach items to, or suspend items from, the purlins. For example, HVAC ducting, water pipes, sprinkler heads, insulation, wiring, conduit, ceiling tiles or ceiling tile supports, or other items commonly located near a roof or above a ceiling may be attached or supported by the purlins. Thus, the roof suspension support 11 can be coupled to a purlin 12 and can be used to support such items. The roof suspension support 11 can be coupled by any suitable method including, but not limited to, welding, bolting, hangers (e.g. onto a lower purlin flange), and the like. However, most often, the suspension support 11 can be attached to the purlin 12 along a lower portion of the purlin such as the lower web portion 14 of the purlin. In one example, the fixture 13 can be coupled to the roof suspension support 11. In a broad sense, the fixture 13 can represent any of the aforementioned items or similar items commonly attached to or supported by the purlins 12. Additionally, the fixture 13 can be a mounting or attachment device for the aforementioned items such as a rail, pipe, wire, bar, tube, hook, rod, ring, sling, or grid. In other words, the roof suspension device can attach directly to a fixture, for example, or the roof suspension device can attach to a rail that supports the fixture such as insulation. Thus, as used herein, the term "fixture" is intended to include a variety of ceiling mounted devices and features, with specific aspects being illustrated by examples. Moreover, the roofing suspension support is specifically contemplated to be coupled or attached to a web of a purlin. A web is a portion of a purlin that extends between an uppermost portion of the purlin and a lowermost portion of the purlin. In the Z-shaped purlins illustrated in the figure, the web extends vertically between a top flange and a bottom flange of the purlin.

Figure 2:
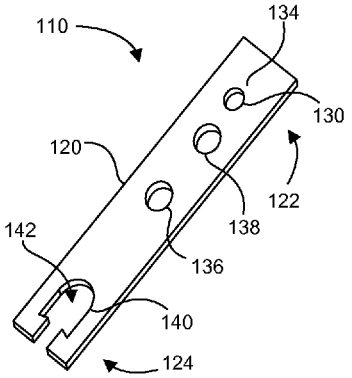
FIG. 2 is a perspective view of a roofing suspension support in accordance with an example of the present disclosure.

Turning now to FIG. 2, illustrated is a roof suspension support 110. The support 110 can include a support member 120 having a top end 122 and a bottom end 124. The support can further include a purlin web coupling portion 130 located at the top end of the support member. The web coupling portion can be configured to couple the support member to a web of a roofing purlin. Additionally, the support can include a fixture coupling feature 140 located at the bottom end of the support member. The fixture coupling feature can be configured to couple a fixture to the support member and to position the fixture below a lower flange of the purlin. In one aspect, the support member can be an elongate member with sufficient length to position the fixture below the lower flange. On the other hand, the support member need not be elongate as long as it is sized to position the fixture below the lower flange. In another aspect, the support can be relatively thin and flat. For example, metal sheets of 0.01" to about 0.060" or about 0.015" to about 0.025" thick can be used. In one aspect, the metal sheets can be about 0.015" thick. For certain applications to support mechanical items, heavier materials can be used. Such a construction can be achieved by manufacturing the support from sheet stock, such as by stamping, water jet, EDM, milling, etc. In a specific aspect, the support member can be substantially planar on a side between the top end and the bottom end and the side can be configured to interface directly with the purlin web.

The support can be coupled to the purlin web using a purlin web coupling portion 130. The web coupling portion can comprise a web coupling feature. In one aspect, shown FIG. 2, the coupling feature 130 can be a hole to receive a fastener. Fasteners can include a bolt with a push on retainer, a push-type fastener, a screw, or any other threaded or unthreaded fastener or coupling device. In another aspect, shown in FIG. 3, the purlin web coupling feature can comprise a tab 232 to interface with a hole in the purlin web. In a particular aspect, the tab can be integrally formed with the support member. Alternatively, the tab can be attached to the support member with a fastener or by welding. Such tabs can be configured to allow a turn-and-lock style engagement (i.e. an elongated profile).

Figure 4A:
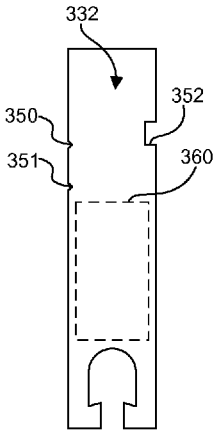
FIG. 4A is a side view of a roofing suspension support in accordance with yet another example of the present disclosure.

In still another aspect, shown in FIG. 4A, the purlin web coupling portion can comprise a solid portion 332 to receive a self-tapping fastener or edges which can be welded to the purlin web. In some aspects, the purlin web coupling portion can comprise a purlin web interface 134 to directly contact a surface of the purlin web. In this case, the roof suspension support can be configured to couple directly to the purlin web. In one example, the purlin web interface can extend away from the support member to provide clearance for the support member around a flange or other protruding portion of the purlin. This may be useful in adapting the support to an I-beam shaped purlin, for example. On the other hand, the support can be coupled to the web via an intermediate member, such as a spacer or other fitting. In this case, it is not necessary for the support to be shaped or configured for direct contact with the purlin web.

Figure 4B:
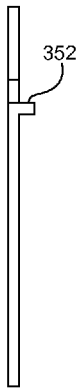
FIG. 4B is a side view of the roofing suspension support in FIG. 4A.
Figure 5A:
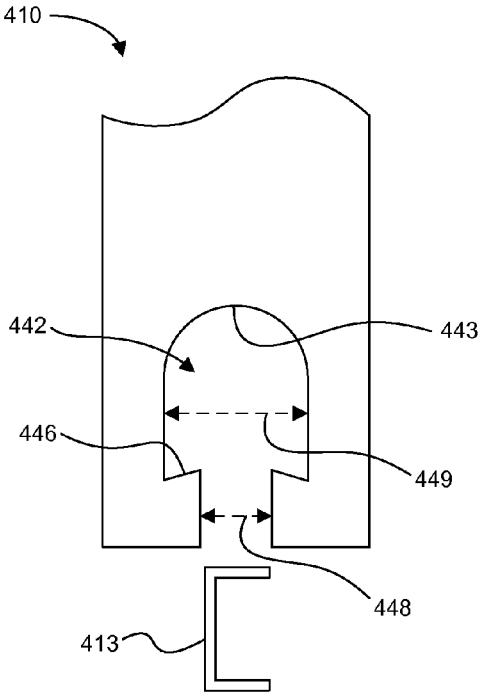
FIG. 5A is a side view of a first step of coupling a fixture and a fixture coupling feature of a roofing suspension support in accordance with an example of the present disclosure.
Figure 5B:
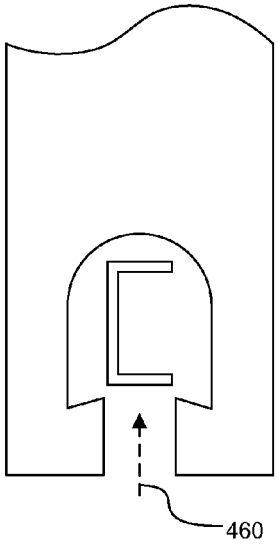
FIG. 5B is a side view of a second step of coupling a fixture and a fixture coupling feature of a roofing suspension support in accordance with an example of the present disclosure.
Figure 5C:
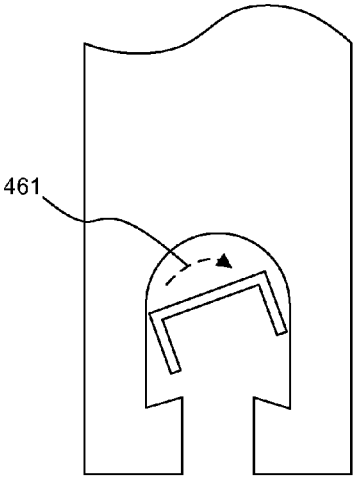
FIG. 5C is a side view of a third step of coupling a fixture and a fixture coupling feature of a roofing suspension support in accordance with an example of the present disclosure.
Figure 5D:
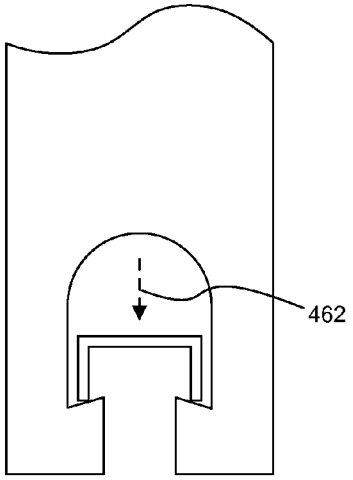
FIG. 5D is a side view of a fourth step of coupling a fixture and a fixture coupling feature of a roofing suspension support in accordance with an example of the present disclosure.

Referring to FIGS. 4A and 4B, the roofing suspension support can further comprise a locating feature to aid in installation of the roofing suspension support by indicating a location of the support member to be substantially aligned with the lower flange of the purlin. In one example, the locating feature can comprise a notch 350, 351 in the support member. In another aspect, the locating feature can comprise a tab 352 extending from the support member. Although two notches and one tab are illustrated in the figure, any number of locating features can be included on the support member (e.g. notches, marks, etc). Another optional locating feature can include holes such as those shown in FIG. 2 as locators 136 and 138, although other shaped openings can be suitable as long as a visual path allows viewing through the support. Holes can allow for visual inspection of the placement from either side of the support relative to the purlin and can improve visibility in low light. Generally, locating features can be useful to provide uniform placement of the supports and allow for a drop distance below the purlins to be chosen for a particular installation.

Figure 3:
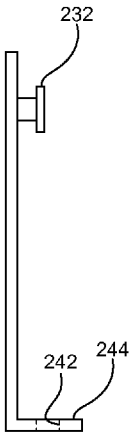
FIG. 3 is a side view of a roofing suspension support in accordance with another example of the present disclosure.

The fixture can be coupled to the roofing suspension support using a fixture coupling feature 140, as shown in FIG. 2. The fixture coupling feature can comprise an opening 142 in the support member. The opening can be sized to allow at least a portion of the fixture to fit therein. In one aspect, the opening can be connected to a bottom (shown) or a side of the support member such that the opening is accessible by the fixture from the bottom or side. In another aspect, the opening may not be connected to a bottom or a side of the support member, as illustrated by the hole 242 in FIG. 3. Thus, in another aspect, the fixture coupling feature can comprise a hole to receive a fastener. Also illustrated in FIG. 3, is an alternate configuration for a bottom end of the support member. For example, the bottom end of the support member can comprise a horizontal portion 244. The hole can be located in the horizontal portion. The horizontal leg can be directed either left or right as needed. In this case, the fixture or fastener can be vertically oriented for interfacing with the support.

With further reference to FIGS. 1, 2, and 4A, the fixture can be configured as a rail, beam, rod or other shape as needed. Such fixtures can be used to support insulation, for example. This aspect is discussed further below. It should be noted here, however, that the purlin web coupling portion and the fixture coupling feature can be located on the support member to position the fixture below the lower flange such that the insulation can fit between the fixture and the lower flange. A range of insulation thicknesses can be accommodated by providing a range of attachment locations for attaching the support member to the purlin web. This is illustrated in FIG. 4A by notches 350, 351 that show two locating positions for guiding installation. Notch 350 can guide installation for a thicker insulation, while notch 351 can guide installation for a thinner insulation. This particular example illustrates a solid web coupling portion for using a self-tapping fastener to couple the support member to the purlin web. However, a range of locations can include multiple holes disposed at different vertical locations to provide different fastening locations. It should also be noted here that the roofing suspension support can include an adhesive 360 disposed on the support member to adhere to the insulation. This can help maintain the insulation in place on the fixture and help ensure proper insulation function.

In yet another option, the support can have a core portion which includes voids which reduce thermal transfer paths across the support clip. For example, sections can be removed from a shank or core portion of the support as long as mechanical integrity is maintained over expected load conditions.

FIGS. 5A-5D illustrate steps of coupling a fixture to a fixture coupling feature of a roofing suspension support in accordance with an example of the present disclosure. Among other things, these figures show that the roofing suspension support 410 can include an opening 442 that includes an angled surface 446 to interface with a fixture 413. The angled surface can be configured to retain the fixture in the opening and improve the coupling stability of the fixture and the support member by guiding the fixture to a stable position under a gravitational force. The opening can also be configured to permit the fixture to be coupled to the support via a bottom (shown) or a side. In this case, the opening can be sized to allow the fixture to pass through a narrow portion 448 into a wider portion 449 of the opening by moving in direction 460. In the wider portion, the fixture can be oriented to engage the angled surface, such as by rotating the fixture in direction 461. Once oriented properly, the fixture can be moved in direction 462 until it comes into contact with the angled surface. The angled surface can help maintain the fixture in position and can prevent the fixture from passing back through the narrow portion of the opening. In one aspect, the material that forms the opening can be thin enough to permit elastic deflection by a human while coupling the fixture to the support. In this case, the narrow portion 448 can be too narrow to permit the fixture to pass through without slight bending or manipulation of the bottom end of the support member around the opening. Thus, the opening can also include a stress relief 443 shaped to minimize stress concentrations about the opening while coupling the fixture to the support. For example, the fixture 413 can be a rail which can be used to support insulation and/or other materials. In one aspect, the rail can be a channel rail having a 9/16" leg length and a 1" width plus or minus as needed, although other dimensions can be suitable (e.g. 2" width and ½" leg length plus or minus as needed). The rail can be formed of a suitable gauge (e.g. 29 gauge or as needed). The narrow portion 448 can be sized to accommodate a narrowest cross-sectional dimension of the fixture. For example, for the 9/16" leg width an opening of about ¾" can be suitable for the narrow portion.

Figure 6A:
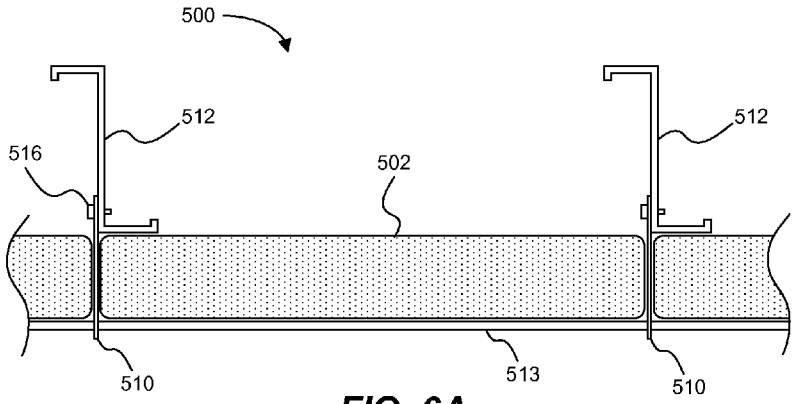
FIG. 6A is a side view of a roofing suspension system in accordance with another example of the present disclosure.
Figure 6B:
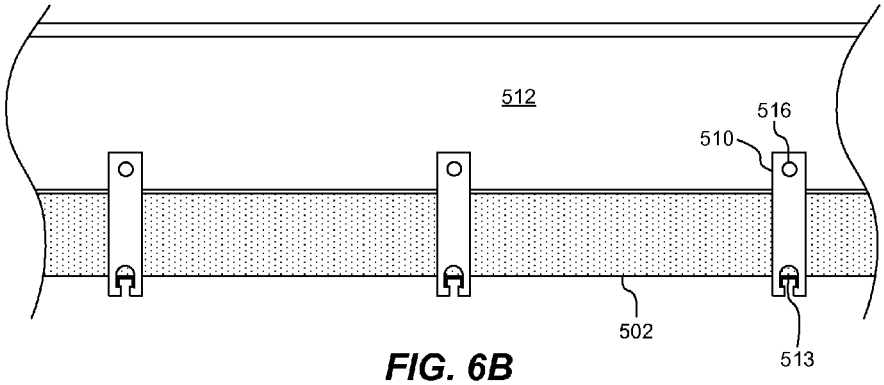
FIG. 6B is another side view of the roofing suspension system in FIG. 6A.

It is also contemplated that a roofing suspension support, as in any of the examples discussed above, can be included in a roofing suspension system in accordance with the present disclosure. For example, as illustrated in FIGS. 6A and 6B, a roofing suspension system 500 can comprise a roofing purlin 512 and a roofing suspension support 510. In one aspect, the system can further include a fixture 513 coupled to the roofing suspension support, such as by a fixture coupling feature of the support.

The purlins 512 can be spaced apart to form a void between purlins and the fixture 513 can span the gap between purlins. Thus, in this example, the fixture can extend from one purlin to another purlin and can be approximately perpendicular to the purlins. However, the fixture can be any shape and can be oriented at any angle as long as the fixture spans a gap between purlins. In another example, the fixture does not span the gap between purlins, but is suspended by only a single purlin. In one aspect, the fixture can run parallel to the purlin that suspends the fixture. However, the fixture can be of any shape and can extend in any direction as long as it is supported by at least one purlin.

With further reference to FIGS. 6A and 6B, in one aspect, insulation 502 can be disposed on the fixture 513. In this case, the fixture can be configured to support the insulation, such as by being in the form of a rail, rod, beam, etc. Supports 510 that are coupled to the same purlin can be separated from one another by about 12 inches to about 60 inches. As shown in the figures, the insulation can be located below the lower flange of the purlin and supported by the fixture. For example, a purlin web coupling portion and a fixture coupling feature can be located on the support member to position the fixture below the lower flange such that the insulation fits between the fixture and the lower flange. The insulation can be any type of insulation known in the art such as fiberglass. In one aspect, the insulation can be adhered to the support member by an adhesive. In a particular aspect, the adhesive can be disposed on the support member.

Additionally, the components of the roof system can be secured together using fasteners. Specifically, the fasteners 516 used in the system are configured to secure the roofing suspension support to the web of the purlin. Generally, any type of fastener such as a threaded fastener or threaded fastener system can be used. Non-limiting examples include screws and bolts, although other mechanisms such as rivets, clips, or the like can be suitable. Alternatively, the roofing suspension support can couple to the web of the purlin with a tab of the support that can engage a hole in the purlin web.

Figure 7A:
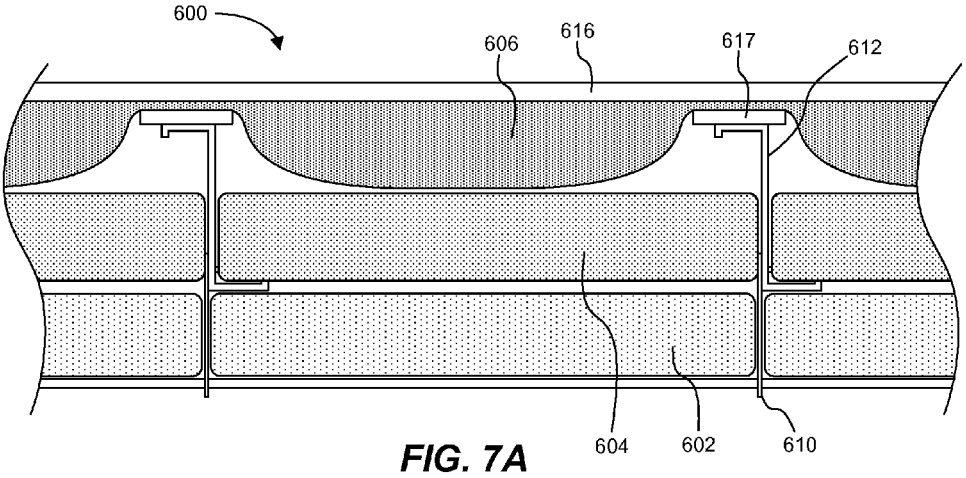
FIG. 7A is a side view of a roofing suspension system in accordance with yet another example of the present disclosure.

FIG. 7A illustrates another example of a roofing suspension system 600, which can include purlins 612, roof panels 616, thermal insulation blocks 617, and insulation 602, 604, 606. The purlins can be arranged in a parallel or substantially parallel array such as shown in FIG. 7A. When the purlins are disposed in the parallel array, voids, gaps, or spaces exist between the purlins.

The roof panels 616 can form an outer roof deck of a roof. As with the purlins 612, the roof panels can be made of any metal or metal alloy known in the art, including but not limited to steel, alloys of steel, aluminum, tin, and the like. The roof panels can be interlocking, corrugated, or of any other design or configuration known in the art. The type and thickness of the roof panels can vary depending on the intended use. In one option, the roof panels can be corrugated 26 gauge metal. When installed, the roof panels can be attached to the purlin by threaded fasteners.

The thermal insulation blocks 617 can be disposed between the roof panel 616 and the purlin 612 so as to reduce or substantially prevent the transfer of heat between the roof panel and the purlin. The thermal insulation blocks can be made of any insulative material known in the art including, but not limited to polystyrene, polyisocyanurate, polyurethane, mixtures thereof, and the like. The thermal insulation blocks can be any size or shape so long as they form an insulative layer between the roof panels and the purlins. Typically, the insulation block can be an elongated block, which substantially coincides with a longitudinal upper surface of the purlin. Additional details in such a thermal insulation block and optional metal cleats can be found in U.S. patent application Ser. No. 12/995,147, filed Nov. 29, 2010 which is incorporated herein by reference.

The voids or gaps between the purlins 612 can be filled with insulation 602, 604, 606. Advantageously, the insulation can be provided in layers. A first insulation layer 602 can be disposed on the fixtures 613. A second insulation layer 604 can be disposed between the purlins and above the first insulation layer. The second insulation layer can be supported by the first insulation layer. A third insulation layer 606 can be disposed above the second insulation layer and can be adjacent to the roof panel. The fixtures can be configured to span the voids between the purlins and to support the weight of any insulation that may be carried by the fixtures, including insulation from any of the layers. The fixtures can also add to the structural support of the roof system and may run substantially perpendicular to the purlins, although this need not be the case.

The combination of the insulation layers can dramatically increase the insulation level of the system. Each of the insulation layers can be formed of compressible insulation. Although other sizes can be used, 2 inch to 6 inch insulation layers are most common. In one aspect, the combined uncompressed width of the first and second insulation layers can be about 6 inches. In these 6 inch cases, R-values from about 22 to about 26 can be achieved.

Figure 7B:
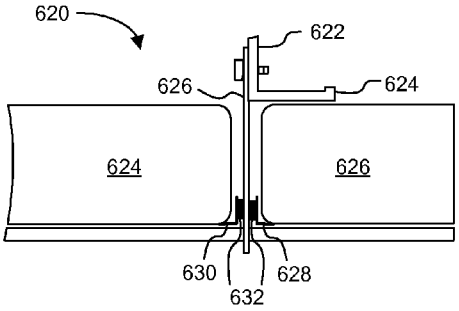
FIG. 7B is a partial side view of a roofing system showing adjacent insulation layers secured to one another and the supports.
Figure 7C:
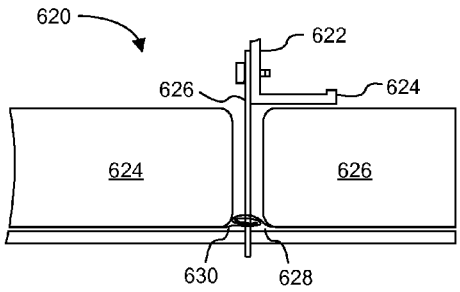
FIG. 7C is a partial side view of another roofing system showing adjacent insulation layers secured to one another and the supports.

Optional adhesives can be used to adhere edges of insulation layers to the supports to reduce heat transfer past the insulation layer(s). Alternatively, insulation tabs from adjacent insulation sheets can be secured together. FIG. 7B and FIG. 7C illustrate different optional approaches to securing adjacent insulation layers together. FIG. 7B shows a lower portion of a roofing suspension system 620 similar to that described in FIG. 7A. Purlin 622 can be oriented having a lower flange 624. The support member 626 is bolted to the lower portion of a web of the purlin 622. Adjacent layers of insulation 624 and 626 can include facing tabs 628 and 630, respectively. The insulation layers and facing tabs run parallel to the purlins such that the support members 626 do not run the full length of the layers. As a result, the facing tabs 628 and 630 can be adhered to one another and the support members 626 via an adhesive 632 such as double sided tape or caulking, for example. FIG. 7C illustrates another roofing suspension system as in FIG. 7B except the facing tabs 628 and 630 are rolled together. Note that the rolled portions would not be rolled at points where the support member 626 extends downward but can be secured together on either side of the support member. The rolled portions can be secured using fasteners such as staples, clips or other mechanisms.

Figure 8:
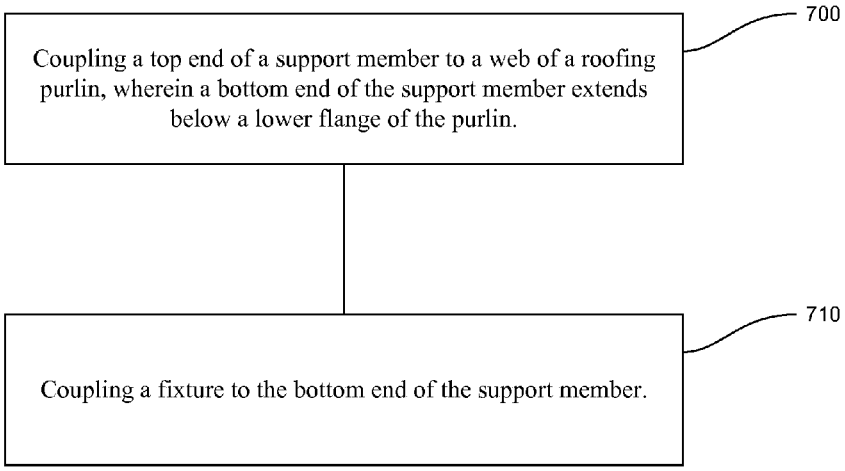
FIG. 8 is a schematic of a method of suspending a fixture from a roof in accordance with an example of the present disclosure.

All embodiments of the roofing suspension supports and systems of the present invention can be used in accordance with the related method. Thus, in a related example, and to reiterate to some degree, a method of suspending a fixture from a roof can comprise coupling a top end of a support member to a web of a roofing purlin, wherein a bottom end of the support member extends below a lower flange of the purlin 700 as outlined in FIG. 8. The method can also comprise coupling a fixture to the bottom end of the support member 710. It is noted that no specific order is required in this method, though generally in one embodiment, these method steps can be carried out sequentially.

In one aspect of the method, coupling a top end of a support member to a web of a roofing purlin can comprise fastening a web coupling portion to the web with a fastener. In another aspect, coupling a top end of a support member to a web of a roofing purlin can comprise coupling a web coupling feature to the web. In a specific aspect, the web coupling feature can include a tab and the web can include a hole, and coupling a web coupling feature to the web can comprise coupling the tab with the hole. In still another aspect, the method can further comprise aligning a locating feature of the roofing insulation support with the lower flange of the purlin.

In an additional aspect, the fixture can be configured to support insulation disposed thereon. In a specific aspect, the bottom end of the support member can extend below the lower flange sufficient to allow the insulation to fit between the fixture and the lower flange. In another specific aspect, the method can further comprise disposing insulation on the fixture. In a more specific aspect, the method can further comprise adhering the insulation to the support member with an adhesive.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A roofing suspension system, comprising:
a fixture;
a roofing purlin; and
a roofing suspension support having
a support member,
a purlin web coupling portion located at a top end of the support member and coupled directly to a web of the purlin, and
a fixture coupling feature located at a bottom end of the support member to couple the fixture to the support member and to position the fixture below a lower flange of the purlin with a bottom-most surface of the fixture resting on a support surface of the fixture coupling feature.

2. The system of claim 1, wherein the fixture is coupled to the fixture coupling feature.

3. The system of claim 2, further comprising insulation disposed on the fixture, wherein the fixture is configured to support the insulation.

4. The roofing suspension system of claim 1, wherein the support member is an elongate member.

5. The roofing suspension system of claim 1, wherein the support member is substantially planar on a side between the top end and the bottom end and the side is configured to interface with the purlin web.

6. The roofing suspension system of claim 1, wherein the purlin web coupling portion comprises a purlin web coupling feature.

7. The roofing suspension system of claim 6, wherein the purlin web coupling feature comprises a coupling hole to receive a fastener or a tab to interface with a purlin hole in the purlin web.

8. The roofing suspension system of claim 1, wherein the purlin web coupling portion comprises a purlin web interface to directly contact a surface of the purlin web.

9. The roofing suspension system of claim 1, wherein the fixture is at least one of a rail, a pipe, a wire, a duct, a bar, a tube, a hook, a rod, a ring, a sling, a grid, or a ceiling tile.

10. The roofing suspension system of claim 1, wherein the fixture is configured to support insulation disposed thereon.

11. The roofing suspension system of claim 10, wherein the purlin web coupling portion and the fixture coupling feature are located on the support member to position the fixture below the lower flange such that the insulation fits entirely between the fixture and the lower flange.

12. The roofing suspension system of claim 1, wherein the fixture coupling feature comprises an opening in the support member and the opening is sized to allow at least a portion of the fixture to fit therein.

13. The roofing suspension system of claim 12, wherein the opening includes a narrow portion, a wider portion above the narrow portion, and the support surface, the narrow portion facilitating passage of the fixture therethrough from a bottom edge of the support member, and the support surface being angled to retain the fixture in the wider portion of the opening and improve the coupling stability of the fixture and the support member by guiding the fixture to a stable position under a gravitational force.

14. A method of suspending a fixture from a roof, comprising:
coupling a top end of a support member directly to a web of a roofing purlin, wherein a bottom end of the support member extends below a lower flange of the purlin; and
coupling a fixture to the bottom end of the support member with a bottom-most surface of the fixture resting on a support surface of a fixture coupling feature.

15. The method of claim 14, wherein coupling a top end of a support member to a web of a roofing purlin comprises fastening a web coupling portion to the web with at least one of a fastener, a tab, and a weld.

16. The method of claim 14, wherein the bottom end of the support member extends below the lower flange sufficient to allow an insulation to fit entirely between the fixture and the lower flange.

17. The method of claim 16, further comprising disposing the insulation on the fixture.

* * * * *